US005597417A

United States Patent [19]

Thönes et al.

[11] Patent Number: 5,597,417

[45] Date of Patent: Jan. 28, 1997

[54] METHOD AND APPARATUS FOR THE PERCUSSIVE CLEANING OF OBJECTS

[75] Inventors: Gustav Thönes, Gummersbach; Ulrich Rottländer, Overath, both of Germany

[73] Assignee: L. & C. Steinmüller GmbH, Gummersbach, Germany

[21] Appl. No.: 318,738

[22] PCT Filed: Feb. 7, 1994

[86] PCT No.: PCT/EP94/00339

§ 371 Date: Oct. 6, 1994

§ 102(e) Date: Oct. 6, 1994

[87] PCT Pub. No.: WO94/18518

PCT Pub. Date: Aug. 18, 1994

[30] Foreign Application Priority Data

Feb. 6, 1993 [DE] Germany ..... 43 03 484.5

[51] Int. Cl.[6] ..... B08B 7/02; F28G 7/00

[52] U.S. Cl. ..... 134/1; 134/6; 134/18; 134/42; 165/84; 165/95

[58] Field of Search ..... 134/1, 6, 18, 42; 165/84, 95

[56] References Cited

U.S. PATENT DOCUMENTS 4,457,361 7/1984 Premel et al. ..... 165/84
4,595,048 6/1986 Pollak et al. ..... 165/84

FOREIGN PATENT DOCUMENTS 3127734 4/1983 Germany .
2147078 5/1985 United Kingdom .

*Primary Examiner*—Zeinab El-Arini
*Attorney, Agent, or Firm*—Robert W. Becker & Associates

[57] ABSTRACT

With a method and apparatus for the percussive cleaning of objects disposed in a chamber that is under process pressure, whereby an elongated percussive element is held below and in contact with the object that is to be cleaned and percussive energy is applied to the percussive element via an accelerated elongated striker, it is provided for a more simple pressure balancing that at least during the acceleration of the striker, the two ends of the striker be maintained at the same pressure, which essentially corresponds to the pressure in the process chamber.

12 Claims, 3 Drawing Sheets

16
15
23
Δp
24
25
12
13
10e
10c
10d
14
10
17
7
8
18
6
2
1
10b
10a

METHOD AND APPARATUS FOR THE PERCUSSIVE CLEANING OF OBJECTS

BACKGROUND OF THE INVENTION

The invention relates to a method and an apparatus for the percussive or beating cleaning of objects disposed in a process chamber that is under process pressure.

A method and apparatus of this type are known from DE-PS 31 27 734. The push member thereof, which is designated as a transmission element, is provided with an equalizing channel that connects the chamber that is under process pressure and the pressure chamber that accommodates the compression spring. Furthermore, the push member is provided with an annular collar. Instead of the pressure equalization channel, the balancing chamber that accommodates the spring can be connected to an externally operated gas pressure balancing apparatus. With both embodiments of the known percussive apparatus, the pressure balancing is thus effected in the region of the push member, so that the latter must have a relatively complicated construction.

With the embodiment having the equalization channel to the chamber that is under process pressure, the danger exists that if dust-containing gases are present in the process chamber, dirt or other contamination can enter the space that accommodates a spring. With both embodiments, the free space that is defined by the one end of the percussive element and by the percussive mechanism is connected to the atmosphere. One end of the striker projects out of the mechanically, pneumatically or hydraulically operating percussive mechanism.

It is therefore an object of the present invention to provide a method and apparatus of the aforementioned general type where the pressure balancing or equalization is effected in a simple manner.

SUMMARY OF THE INVENTION

This object is realized in that at least during acceleration of the striker, the two ends of the striker are maintained at the same pressure, which corresponds essentially to the pressure in the process chamber.

In this manner, the required pressure equalization is no longer carried out in the region of the percussive element, but rather in the region of the mechanically, pneumatically or hydraulically operating percussive mechanism, so that no dirt or contamination can enter the spring chamber via a free or exposed equalization channel, which could very rapidly lead to disruptions in operation; furthermore, a more straightforward configuration of the percussive or beating element is possible. The percussive element can be held in abutment under a resilient bias via at least one spring or via a pneumatic load.

Further features are directed to advantageous specific embodiments of the method.

The invention is also directed to a percussive or beating apparatus for the percussive cleaning of objects disposed in a process chamber that is under pressure. The apparatus includes a housing, an elongated percussive or beating element that is guided in the housing in a sealed manner, extends through the wall of the process chamber, and rests against the object under the effect of a biasing means, and furthermore includes a percussive mechanism including an elongated striker that is designed for the percussive element. One end of the percussive element and the associated end of the striker extend into a free space or chamber of the housing in such a way that in a state of rest of the percussive mechanism, the two ends are spaced from one another by a distance that is a function of the available percussive energy.

This apparatus is inventively characterized in that the percussive element has an essentially rectilinear cylindrical configuration, and in that that end of the striker that projects out of the percussive mechanism and is remote from the percussive element is surrounded by a balancing or equalization chamber that communicates with the free space in the housing and is subjected to a pressure that corresponds essentially to the process pressure.

The connection or communication of the free space with the balancing chamber can be achieved by a connecting line that is disposed outside of the housing, or can be achieved by at least one balancing channel that is guided through the striker.

With the preferred biasing of the percussive element with a spring, the latter is disposed in the free space, so that the free space serves not only for accommodating the spring but also for providing the acceleration path that is necessary for the operation of the apparatus.

Furthermore, as viewed in the direction of beating, an annular chamber that can be supplied with sealing gas introduced through the housing is provided after a seal means that is associated with the spring biased end of the percussive element. The sealing gas can be the same gas, for example nitrogen, as is used for supplying the free space and the balancing chamber.

This sealing gas can be held in the annular chamber by a further seal means disposed after the annular chamber, as viewed in the direction of beating, and/or can exit through a gas permeable filter in a direction toward the percussive or beating end of the percussive element.

Furthermore, it is expedient to provide that end of the housing that faces the object with a guide collar that surrounds and is spaced from the percussion element, with the free end of the guide collar additionally guiding the percussion element at a distance from the wall that bounds the process chamber.

The free space and the balancing chamber are preferably supplied with a pressure that is lower than that of the annular chamber. However, it is also possible to supply the same pressure to the free space, the balancing chamber and the annular chamber if this pressure is somewhat greater than the process pressure. In this connection, it must be noted that in the claims and in the specification it is indicated that the balancing or equalization pressure that acts upon the striker should essentially correspond to the process pressure. This means that the balancing pressure should not deviate significantly from the process pressure, since otherwise the beating element that operationally is held against the object that is to be cleaned under the influence of the spring, is acted upon by an additional force.

BRIEF DESCRIPTION OF THE DRAWINGS

The invention will now be described in greater detail in conjunction with the accompanying drawings. Shown are FIG. 1 a cross-sectional view through the inventive apparatus, with the equalizing or balancing pressure differing from the pressure of the sealing gas, FIG. 2 an apparatus where the balancing pressure is the same as the sealing pressure, FIG. 3 an embodiment similar to that of FIGS. 1 and 2, whereby however the pressure balancing between the balancing chamber and the free space rather than being effected by an externally disposed balancing line, is effected by a balancing channel in the striker, and whereby the end position of the striker when striking movement is activated can be detected by a position-measuring device.

DESCRIPTION OF PREFERRED EMBODIMENTS

Figure 1:
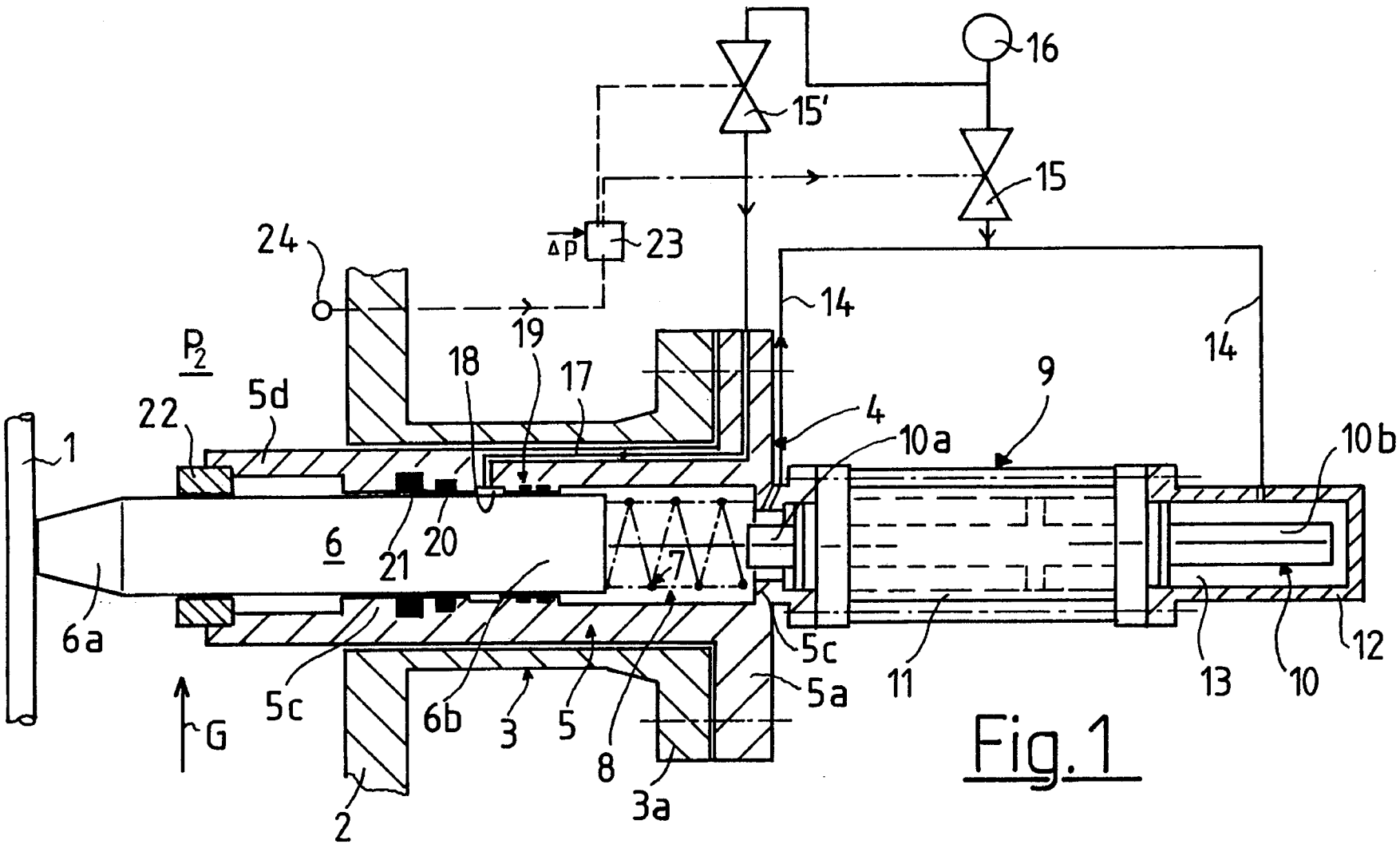

FIG. 1 schematically illustrates the object that is to be cleaned in the form of a heat transfer surface 1 that is composed of tubes and that is disposed in the pressure vessel 2 of a coal gasification unit. The heat transfer surface is subjected to the flow of dust-laden gas G at least from the outside.

Provided on the wall of the pressure vessel 2 is a connector 3 having a mounting flange 3*a* for the attachment of the percussive or beating mechanism 4. The percussive mechanism 4 has a housing 5 with a mounting flange 5*a* via which it can be bolted or otherwise attached to the connector. An essentially rectilinear cylindrical percussive or beating element 6 is mounted in the housing 5 so as to be axially displaceable. The conically tapered percussive end 6*a* rests against the heat transfer surface 1 subject to the action of a compression spring 7 that on the one hand is supported against the other end 6*b* of the percussive element and on the other hand is supported against a shoulder 5*b* of the housing. The end 6*b* extends into a free space or chamber 8 that is provided in the housing and that also accommodates the spring.

Detachably connected to the housing 5 is a striker 9 that in FIG. 1 is embodied as a double acting pneumatic piston cylinder drive mechanism. The two ends 10*a* and 10*b* of the piston rod 10 project out of the cylinder 11. The percussive element 6 and the piston rod 10 are aligned with one another and are disposed in the same axis. The end 10*a* of the piston rod 10 also projects into the free space 8. The other end 10*b* of the piston rod is surrounded by a pressure balancing or equalization housing 12 that delimits a balancing or equalization chamber 13. The free space or chamber 8 and the balancing chamber 13 are interconnected by a line 14 that in turn is connected via a pressure regulating valve 15 to a pressure source 16, preferably a $N_2$ source.

Provided in the housing 5 is a channel 17 that extends to an annular chamber 18 formed in the guide portion 5*c* of the housing and that via a regulating valve 15' is also connected to the pressure source 16. Provided on that portion of the percussive element 6 that is associated with the end 6*b*, next to the annular chamber 18, is a multi-part seal means 19. On the other side of the annular chamber 18, as viewed in the percussive or beating direction, is first a compact seal 20 and then a metal fabric ring 21 that acts as a filter. In this way, the sealing effect of the seal means 19 and 20 is such that gas that is introduced via the channel 17 cannot exit via the seal means 19 but rather exits in a precise manner via the components 20 and 21 into the chamber in the pressure vessel that is under the process pressure $P_2$.

That end of the housing 5 that faces the heat transfer surface is provided with a guide collar 5*d* that extends around and is spaced from the percussive element 6, with an annular part 22 that surrounds the percussive element and guides the same being disposed on the free end of the guide collar. A control unit 23 is provided for the control of the regulating valves 15 and 15'; a control signal derived from the process pressure $P_2$ via a measuring device 24 is conveyed to the control unit. In the embodiment illustrated in FIG. 1, the valve 15 is regulated in such a way that a pressure that corresponds to the process pressure $P_2$ is established in the free space 8 and in the balancing chamber 13. The force with which the percussive element 6 rests against the heat transfer surface 1 is then essentially determined merely by the force of the spring 7. When the piston is accelerated along the path from its rest position illustrated in FIG. 1 until it strikes the end face of the end 6*b*, a pressure equalization or balancing is effected between the chambers 8 and 13 via the line 14. The pressure that exists in the annular chamber 18 is set to be somewhat greater than the process pressure $P_2$ by the control unit 23 in conformity with a pressure $\Delta p$ via the regulating valve 15'. To summarize: $P_2=P_8=P_{13}$, and $P_{18}$ is somewhat greater than $P_2$.

Figure 2:
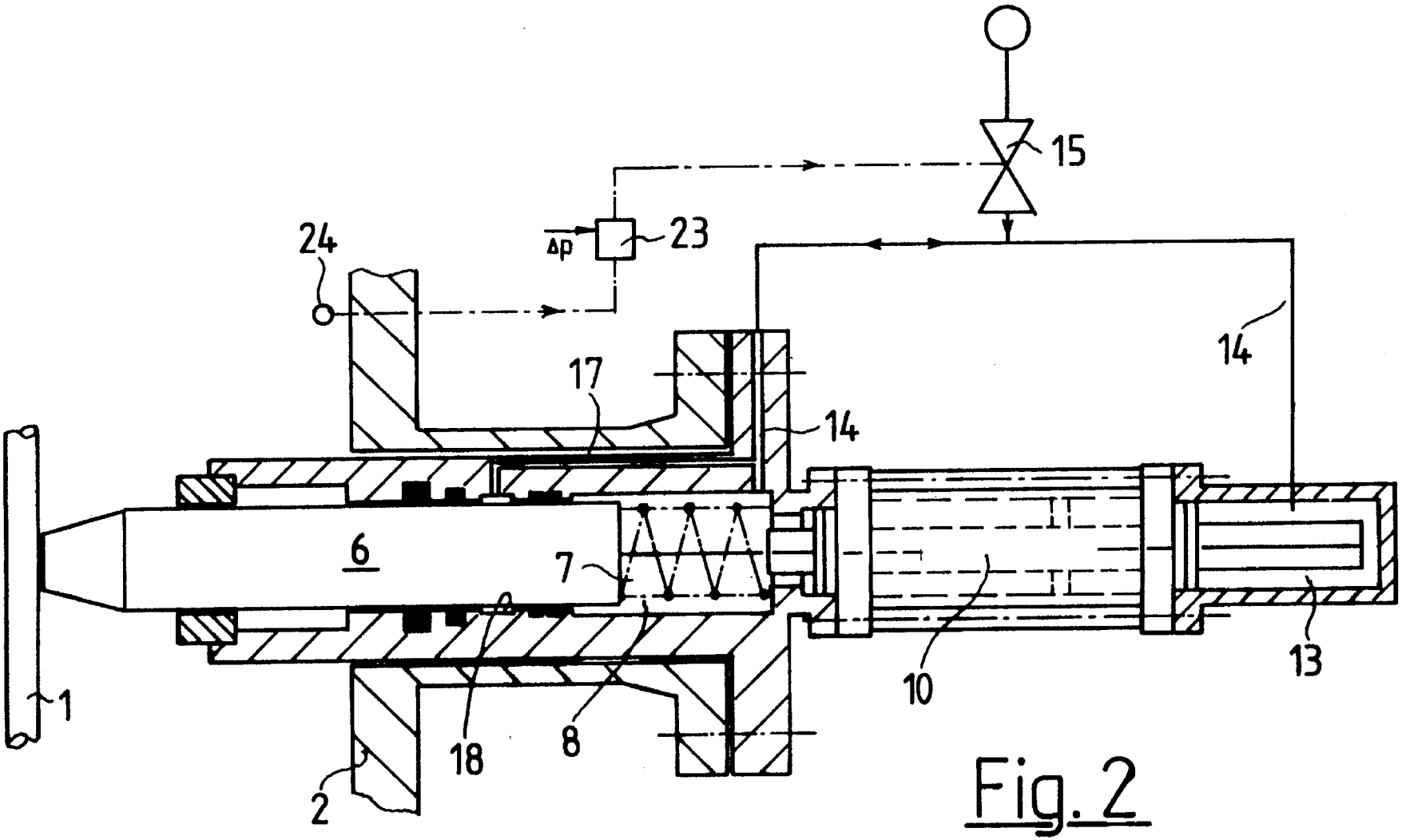

In the embodiment illustrated in FIG. 2, the channel 17 is connected directly to the connecting line 14, so that the control unit 23 controls only the regulating valve 15. In this case, the following applies: $P_8=P_{13}=P_{18}$, and $P_2$ is somewhat less than $P_8$.

In the embodiment of FIG. 2, the spring 7 could be dispensed with, since due to the $\Delta p$ to the pressure $P_2$, an abutment of the percussive element 6 against the heat transfer surface 1 is taken care of. However, due to possible pressure fluctuations in the process chamber, a spring 7 should be provided.

From the description of the drawings, it can be seen that the required pressure balancing relative to the vessel pressure $P_2$ is not achieved by a particular stressing and configuration of the percussive element, but rather via a straightforward configuration and manner of operation of the striker drive. By the directed introduction of a sealing gas into the region of the push member via the annular chamber 18, a directed leakage in a direction toward the interior of the pressure vessel 2 is achieved, so that a deactivation of the entire percussive chamber is achieved. This inhibits corrosion. Furthermore, by means of the leakage flow, the seal means that is provided for dust filtration is kept free.

Figures 3, 4:
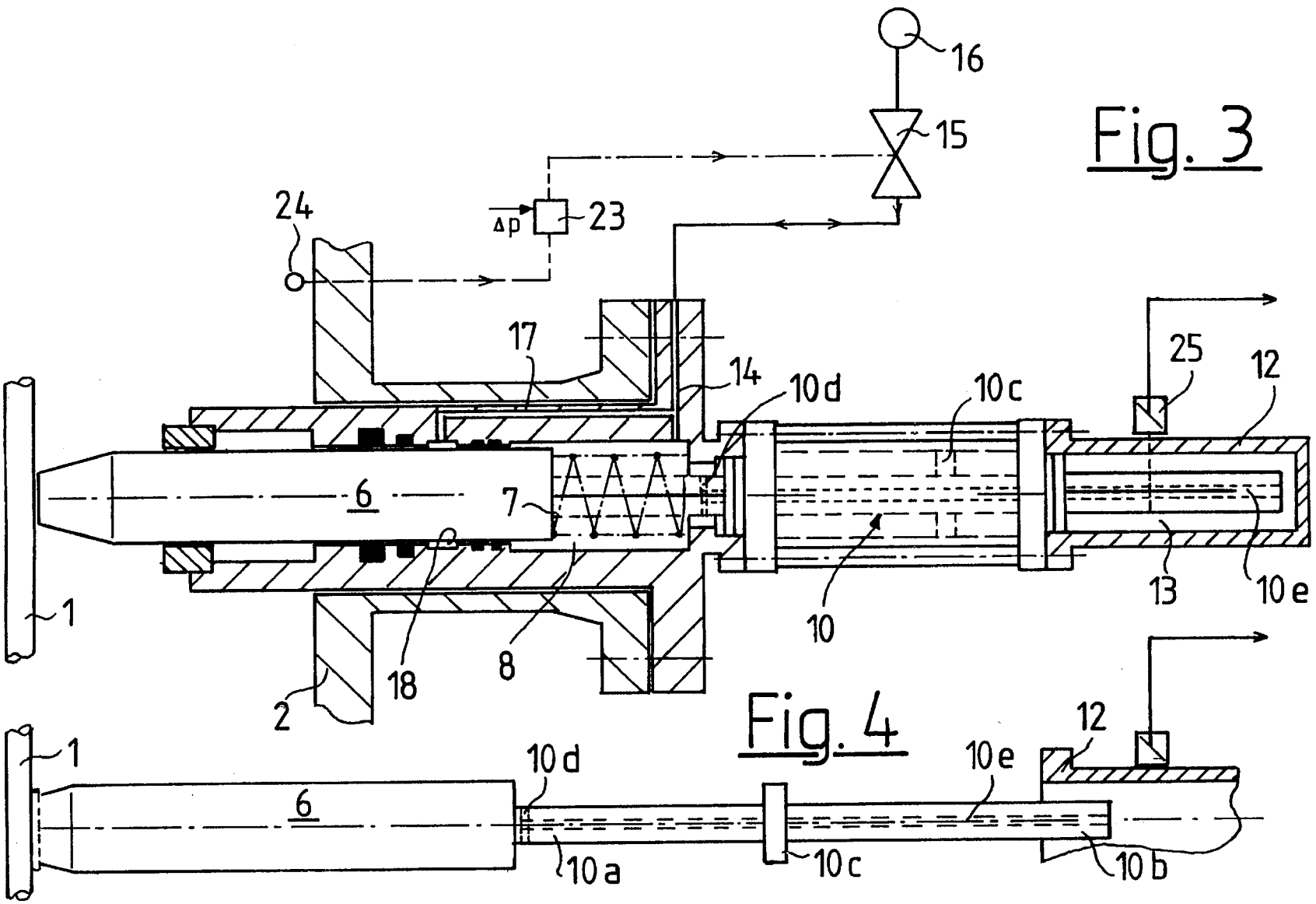
FIG. 4 is a partial view of the arrangement of FIG. 3 where the percussive end of the percussive element is deformed, and with the striker being shown in the striking position.

In the specific embodiment illustrated in FIGS. 3 and 4, the pressure balancing between the free space 8 in the housing 5 is not effected by the partial branch of the line 14 that in FIGS. 1 and 2 branches off from the outlet of the valve 15 and leads to the pressure balancing chamber 13, but rather is effected via a pressure balancing channel that leads from the end 10*a* of the piston rod 10 to the end 10*b* of the piston rod. This pressure balancing or equalization channel comprises radial bores 10*d* and the channel 10*e* that extends through the piston rod 10, preferably axially centrally.

In FIG. 3, the piston rod 10 with its piston 10*c* is shifted by the spring 7 into its right hand end position. Upon activation of the piston cylinder drive mechanism, the piston rod is accelerated toward the left, in FIG. 3, until it strikes the percussive element 6.

As can be seen in FIG. 4, during the course of operation and as a consequence of frequent percussive or beating movements, the working end of the percussive element 6 deforms, i.e. the end position of the right end 10*b* is displaced toward the left in FIGS. 3 and 4 by a corresponding amount.

A measured value detector 25 is disposed on the pressure balancing housing 12 for detecting the shortening of the percussive element 6 by detecting the displacement of the end position of the piston rod of the actuated piston cylinder drive mechanism. This is schematically indicated in FIG. 4. Suitable measured-value detectors are inductive or capacitative proximity initiators that are disposed outside the housing 12. It is also conceivable to provide photoelectric arrangements within the balancing chamber 13. It is also possible to dispose a mechanical/electrical measuring pin as a limit switch within the balancing chamber.

When the output signal of the proximity initiator indicates the presence of a deformation of the percussive element that is no longer acceptable for the percussive or beating operation, the percussive element must be replaced. The present invention is, of course, in no way restricted to the specific disclosure of the specification and drawings, but also encompasses any modifications within the scope of the appended claims.

What we claim is:

1. A method for percussively cleaning an object disposed in a process chamber that is under process pressure, said method including the steps of:

providing an elongated percussive element below and in contact with said object that is to be cleaned;

providing an elongated striker having two ends;

accelerating said striker to apply percussive energy to said percussive element to effect said percussive cleaning of said object; and at least during said acceleration of said striker, maintaining an identical pressure at said two ends of said striker, with said identical pressure corresponding essentially to said pressure in said process chamber.

2. A method according to claim 1, which includes the steps of detecting said process pressure in said process chamber, and establishing said pressure that acts upon said two ends of said striker as a function of a detected process pressure.

3. A method according to claim 1, which includes the step of applying a sealing gas at a distance, viewed in a percussive direction, from an end of said percussive element that is acted upon by said striker in such a way that said sealing gas can at most exit in a direction toward a percussive end of said percussive element.

4. A method according to claim 3, which includes the step of resiliently biasing said percussive element to maintain contact of said percussive element with said object.

5. An apparatus for percussively cleaning an object disposed in a process chamber that is under process pressure, said apparatus comprising:

a housing having a free space;

an essentially rectilinear, cylindrical, elongated percussive element that is guided in said housing in a sealed manner and has two ends, one of which extends through a wall of said process chamber and rests against said object under the effect of a biasing means, with the other end of said percussive element extending into said free space; and a percussive mechanism that includes an elongated striker for acting upon said percussive element, said striker having two ends, one of which extends out of said percussive mechanism remote from said percussive element, and the other of which extends into said free space and, in a rest position when said striker does not act upon said percussive element, is spaced from said other end of said percussive element, said one end of said striker that extends out of said percussive mechanism being surrounded by a balancing chamber that is in communication with said free space of said housing and is subjected to a pressure that corresponds essentially to said process pressure.

6. An apparatus according to claim 5, wherein said biasing means for said percussive element is a spring that is disposed in said free space of said housing.

7. An apparatus according to claim 6, wherein said housing is provided with a first seal means that is associated with said other end of said percussive element, which is under the effect of said biasing means, and wherein said housing, when viewed in a percussive direction, is provided after said first seal means with an annular chamber that can be supplied with sealing gas that is supplied through said housing.

8. An apparatus according to claim 7, wherein, when viewed in said percussive direction, said housing is provided after said annular chamber with at least one of a further seal means and a gas-permeable filter.

9. An apparatus according to claim 8, wherein an end of said housing that faces said object is provided with a guide collar that surrounds and is spaced from said percussive element, with said guide collar having a free end for guiding said percussive element at a distance from said wall that bounds said process chamber.

10. An apparatus according to claim 7, wherein said free space and said balancing chamber are supplied with a pressure that is less than a pressure of said annular chamber.

11. An apparatus according to claim 7, wherein said free space, said balancing chamber, and said annular chamber are supplied with an identical pressure, which is greater than said process pressure.

12. An apparatus according to claim 5, which includes a position-detecting means that is associated with said one end of said striker that extends into said balancing chamber for detecting changes in striking end positions of said striker.

* * * * *